United States Patent [19]

Folgerö

[11] Patent Number: 4,666,134

[45] Date of Patent: May 19, 1987

[54] STOPPER MEANS IN POURING FURNACES

[75] Inventor: Kare Folgerö, Västerås, Sweden

[73] Assignee: ASEA Aktiebolag, Västeras, Sweden

[21] Appl. No.: 833,071

[22] Filed: Feb. 26, 1986

[51] Int. Cl.[4] ..... C21C 5/48

[52] U.S. Cl. ..... 266/272; 222/597

[58] Field of Search ..... 266/45, 272, 236; 222/597, 596, 591, 590

[56] References Cited

U.S. PATENT DOCUMENTS 3,341,092 9/1967 Finn ..... 222/597

3,892,395 7/1975 Hazlehurst ..... 266/272

*Primary Examiner*—L. Dewayne Rutledge

*Assistant Examiner*—S. Kastler

*Attorney, Agent, or Firm*—Watson, Cole, Grindle & Watson

[57] ABSTRACT

A stopper means to prevent melt leaving a metallurgical container, comprises at least one stopper rod and a corresponding tapping nozzle having a tap hole for the melt, a plunger being arranged substantially centrally in the stopper rod and being movable up and down through the tapping nozzle in order to prevent blockage of the tap hole. The device is characterized in that the plunger is movable into the tap hole from a normal position, in which the plunger is positioned completely above the maximum level of melt in the container.

8 Claims, 3 Drawing Figures

7
20
23
21
22
24
4
8

STOPPER MEANS IN POURING FURNACES

TECHNICAL FIELD

This invention relates to a stopper means to control the egress of molten metal from a pouring furnace or other metallurgical container. The stopper means comprises at least one stopper rod and a corresponding tapping nozzle having a tap hole for the molten metal, a plunger being arranged substantially centrally in the stopper rod and being movable upwardly and downwardly through the tapping nozzle for preventing blockage of the tap hole.

DISCUSSION OF PRIOR ART

A stopper means of the above described kind has been used to solve a problem caused by slag partially blocking the tap hole in the tapping nozzle and thereby resulting in a reduction in the casting flow rate which in turn leads to inaccurate casting. One example of equipment which has been improved by the use of a plunger-equipped stopper rod is ASEA's casting furnace of the type known as a PRESSPOUR ® furnace (described in ASEA Pamphlet AU 10-103) used for example for casting nodular iron.

One problem which has arisen with the known plunger-equipped stopper rod, is the relatively short service life of the stopper means due to rapid deterioration of the plunger under the severe operating conditions it experiences. This in turn adds to the expense of the casting process due to down-time to replace or repair the plunger and the cost of replacing or repairing the plunger.

OBJECTS OF THE INVENTION

One object of the invention is to provide an improved self-cleaning stopper means for a metallurgical furnace or other melt-containing vessel. A further object is to provide a plunger-equipped stopper rod for a stopper means which has an improved service life before there is need to service or replace the plunger. A still further object is to maximise the through-put of a metallurgical furnace by preventing unwanted blockages occurring in the tapping nozzle and at the same time to protect the blockage-preventing means from excessive attack by the melt to be poured.

SUMMARY OF THE INVENTION

The present invention is an improvement of the known device and is characterized in that the plunger, although movable into the tap hole is normally retained in a position located completely above the normal maximum level of the melt in the furnace or container. A stopper means according to the invention thus ensures a maximum life of the plunger because the tip of the plunger, in its normal position, will be located above the melt in the container or furnace.

The tip of the plunger is suitably made of a heat-resistant material with a minimum scaling temperature (e.g. oxidation temperature) of about 1150° C. The plunger is conveniently made to be turnable about its longitudinal axis with the stopper rod, whereby a combined reciprocating and turning movement is obtained, the combined movement assisting in breaking up encrustations which might form in the tap hole.

In a preferred embodiment, the plunger has a diameter at its lower part which is some 20–30% smaller than the diameter of the passage in the stopper rod and/or of the diameter of the tap hole in the tapping nozzle. During casting of, for example, nodular iron it is not only the tap hole in the tapping nozzle than can become clogged but also the sealing surface between the tapping nozzle and the stopper rod is subjected to the adherence of slag.

Preferably the stopper means is designed so that the plunger can always be moved up to its normal above-melt rest position from its downmost in-tap-hole position even if some material has solidified around the hole in the tapping nozzle or the walls defining the passage in the stopper rod.

BRIEF DESCRIPTION OF THE DRAWINGS

The invention will now be described in greater detail, by way of example, with reference to the accompanying drawings, wherein.

DESCRIPTION OF PREFERRED EMBODIMENT

Figure 1:
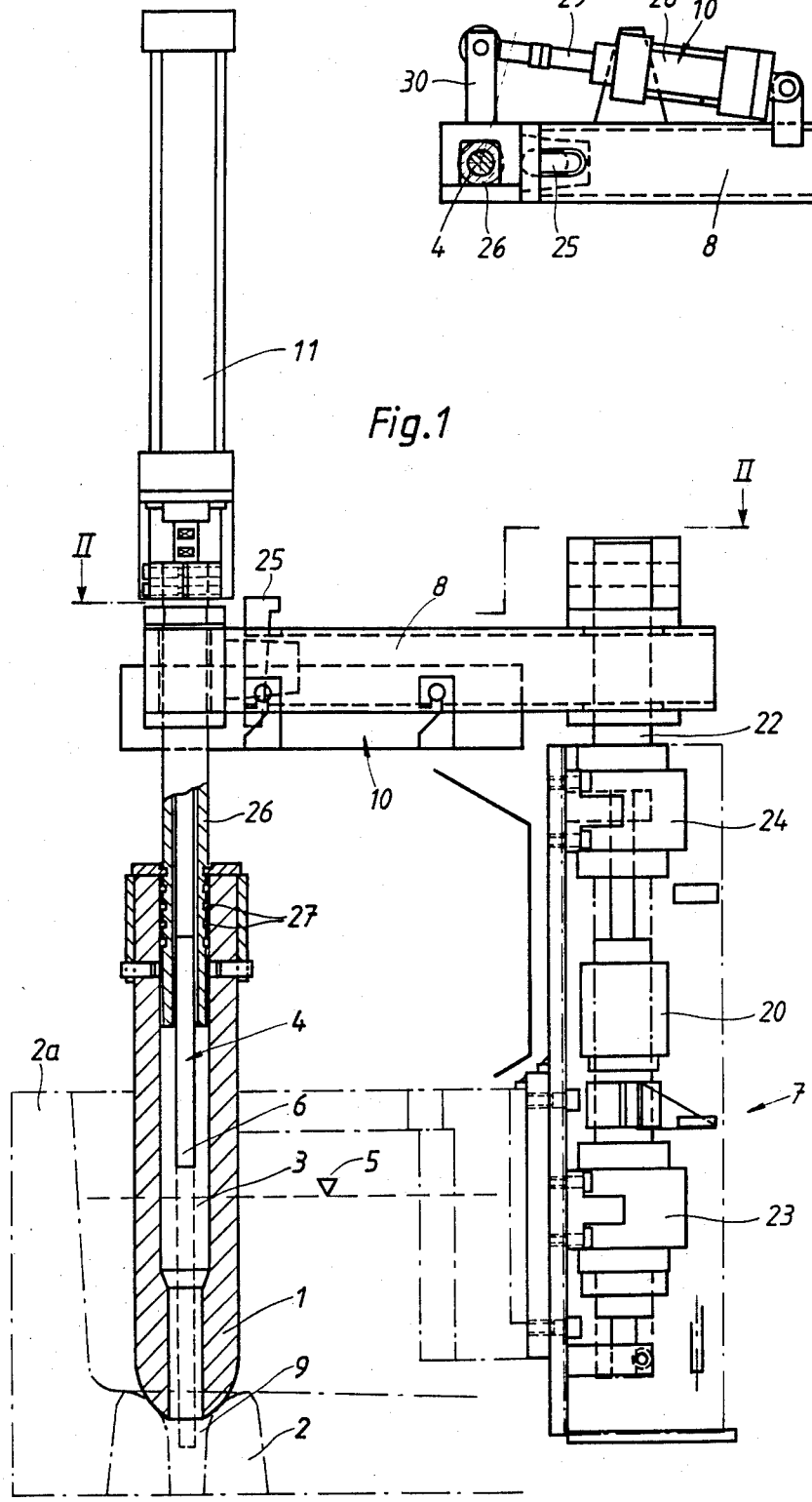
FIG. 1 shows, in partial cross-section, a stopper means according to the invention.

Similarly as described in the aforementioned pamphlet, FIG. 1 shows a stopper rod 1 which is intended to seal the upper end of a tapping nozzle 2 in a pouring furnace or other metallurgical container 2*a*. A plunger 4 is movably located in a longitudinal channel 3 in the stopper rod 1. Such a plunger-equipped stopper rod provides a solution in a known manner to the problem of frequent cleaning of tapping nozzle 2. Without the plunger-equipped stopper rod, the casting process had to be interrupted at relatively frequent intervals to clean slag from tapping nozzle 2. Moreover, the problem of leakages at the sealing surface between stopper rod 1 and tapping nozzle 2, which can arise in controlled (e.g. pressure) casting, is avoided by this prior art plunger-equipped stopper rod.

In accordance with the invention, the plunger 4 is movable downwards from its normal rest position completely above the maximum bath level 5 in the furnace/-container. The tip 6 of the plunger 4 is suitably made of a heat-resistant material with a minimum scaling temperature of about 1150° C. in order to prevent oxidation or other damage due to the high temperature operating conditions to which it is subjected in use.

The tubular stopper rod 1 is driven between its extreme upper and lower positions by means of a drive unit 7 located at the side of and adjacent to the plunger 4/stopper rod 1. The drive means 7 is shown in greater detail in FIG. 3 and is connected to the stopper rod 1 by means of an arm 8.

Figure 3:
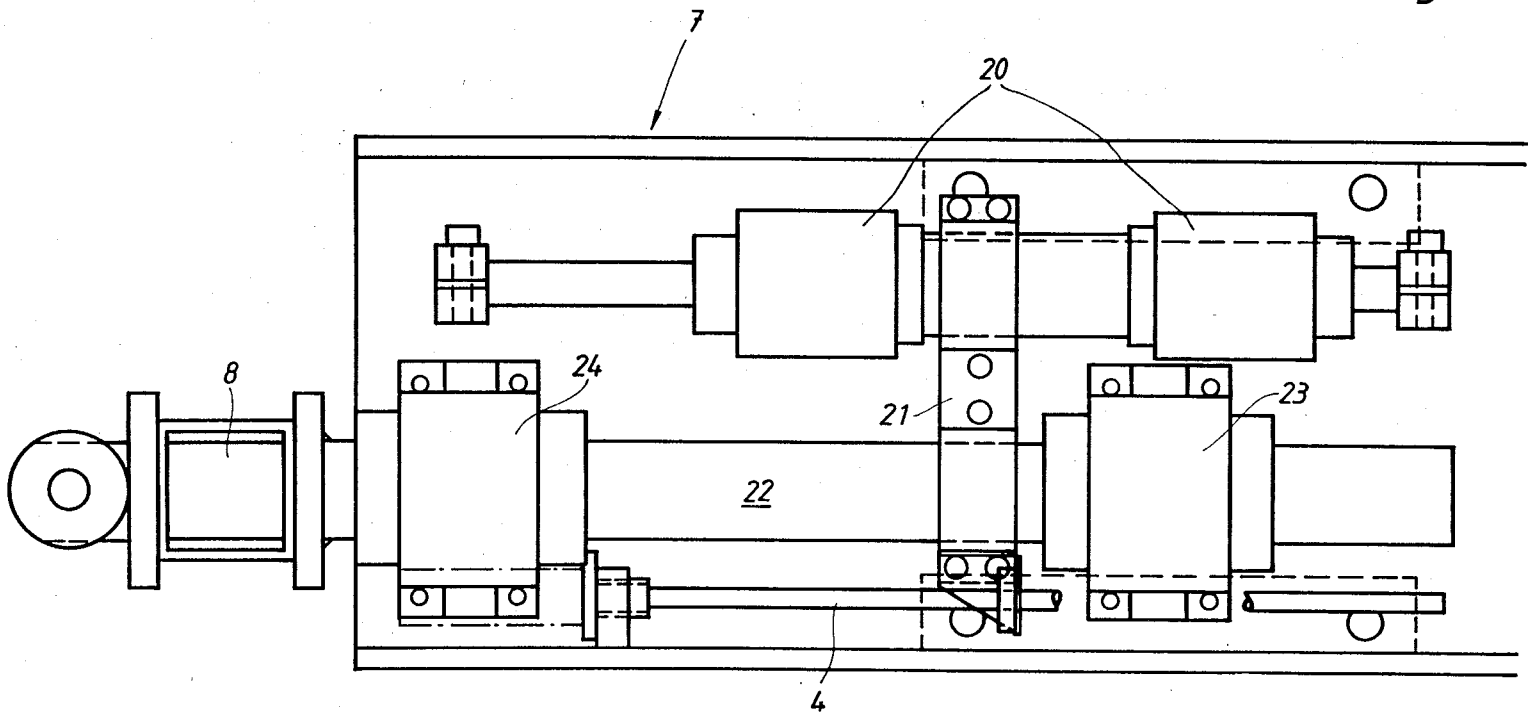
FIG. 3 is an enlarged side view of the drive means used for imparting reciprocating movement to the stopper rod.

The drive means 7 is shown in more detail in FIGS. 1 and 3 than needs to be described herein, since the purpose of the drive means is simply to lower the stopper rod 1 into sealing engagement with the tapping nozzle 2 at the end of a casting operation and to lift the stopper rod 1 clear of the nozzle 2 at the start of a casting operation.

The unit shown in FIG. 3 comprises a double-acting pneumatic or hydraulic piston-in-cylinder unit 20 linked by a clamp 21 to a vertically slidable rod 22 guided by bushings 23 and 24. The upper end of the rod 22 is clamped to the arm 8 so that as the unit 20 moves upwardly or downwardly, the arm 8 also moves upwardly or downwardly. Locating the unit 7 to one side of the rod 1/plunger 4 reduces the overall height of the stopper means and makes for a compact robust design.

Attached to the free end of the arm 8 by a removable key 25 is the combined stopper rod 1/plunger 4. The tubular stopper rod 1 is removably mounted on the lower end of a hollow shaft 26 in the appropriate one of a number of locating grooves 27. In FIG. 1 the uppermost groove 27 has been used but for a somewhat shorter rod 1, a lower groove could be chosen.

Passing axially through the shaft 26 is the plunger 4, this being moved from its uppermost position (shown in full lines in FIG. 1) to a downward position (shown dotted in FIG. 1) in which it enters the tap hole 9, by a pneumatic or hydraulic piston-in-cylinder unit 11.

Figure 2:
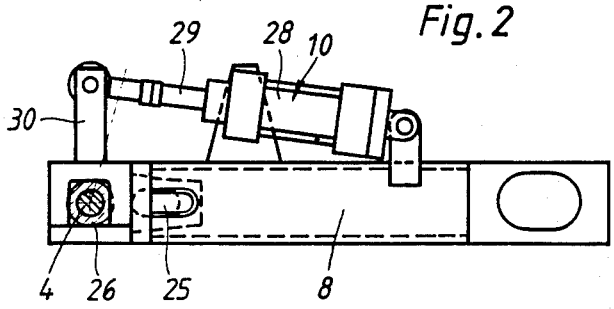
FIG. 2 shows a section on the line II—II of FIG. 1 of the part of the stopper means used for turning the plunger in the stopper rod.

Hanging on the arm 8 is a unit 10 which is used to impart a few tens of degrees of turning movement to the plunger 4 and the shaft 26. As can be seen in FIG. 2, the unit 10 comprises a third piston-in-cylinder unit 28, the ram 29 of which is coupled to a radially directed arm 30 of the shaft 26. Thus, if the unit 28 is contracted, the arm 30 will turn to the right in FIG. 3 and if the unit 28 is extended, a turn to the left will be produced. The turning of the shaft 26 will cause the plunger 4 and the control rod 1 to turn together (since the unit 11 is clamped to the upper end of the shaft 26).

The unit 11 is arranged so that a considerably larger lifting force is generated on the plunger 4 than the lowering force. This can easily be arranged by ensuring that the driving fluid has the same pressure for both movements but that the driving fluid acts on a larger area for the upward movement than for the downward movement and/or by using a higher pressure for the upward movement.

To obtain smooth, reliable operation of the plunger 4, the diameter of the plunger 4 should be 20–30% smaller than the diameter of the hole 3 in the stopper rod 1 and/or the tap hole 9 in the tapping nozzle 2. It has been found that with a plunger of this size, the plunger 4 can be withdrawn from its lowermost position even if some solidified coatings have formed in the holes 3 and 9. The movement of the plunger 4 is arranged so that it remains in its lowermost position for as short a period as possible and (as discussed above) that the force which gives the plunger 4 its downward movement is considerably smaller than the force which gives the plunger 4 its upward movement. The reason for this difference in force in the two directions is that if the plunger 4, during its downward movement, gets stuck by solidified material, a greater upward force will be available to pull the plunger 4 clear of the restraining obstruction.

During casting of nodular iron, for example, not only the tap hole 9 in the tapping nozzle 2 may become clogged, but also the sealing surface between the tapping nozzle 2 and the stopper rod 1 is subjected to the adherence of slag. To prevent this adherence of slag, the stopper rod 1 is provided with the turning device 10 shown in FIG. 2 which is mounted on the arm 8.

A combined reciprocating and turning movement of the rod 1 is thus available, where the reciprocating movement has a certain minimum length of stroke, set by the drive means 7.

The invention may be varied in many ways within the scope of the following claims.

What is claimed is:

1. In a stopper means to control the egress of molten material through a tap hole in a tapping nozzle provided in a container of such molten material, which stopper means includes at least one stopper rod having a passage therein, said stopper rod being used for closing the tap hole, means to raise the stopper rod from the tapping nozzle to allow material flow from the container through the tap hole and to lower the stopper rod onto the tapping nozzle to stop such flow, a plunger having an axis arranged substantially centrally in the stopper rod and means to move the plunger in the direction of its axis up and down through the tapping nozzle in order to prevent blockage of the tap hole, the improvement wherein the plunger is disposed in a normal rest position completely above the maximum level of molten material in the container, and the plunger in its lowermost position enters the tap hole, and means is provided to turn the plunger about its axis with the stopper rod.

2. A stopper means according to claim 1, in which at least the tip of the plunger is made of a heat resistant material.

3. A stopper means according to claim 1, in which the minimum scaling temperature of the plunger is about 1150° C.

4. A stopper means according to claim 1, in which the diameter of the lowermost part of the plunger is 20–30% smaller than the diameter of the passage in the stopper rod.

5. A stopper means according to claim 1, in which the diameter of the lowermost part of the plunger is 20–30% smaller than the diameter of the tap hole in the tapping nozzle.

6. A stopper means according to claim 1, in which the means to raise/lower the stopper rod comprises a drive means located at the side of the plunger and connected to the stopper rod by means of a link arm.

7. A stopper means according to claim 6, in which the drive means is a piston-in-cylinder unit.

8. A metallurgical furnace comprising a container for melt having a tapping nozzle with a tap hole melt poured into the container can flow out of the container, a hollow stopper rod mounted above the tapping nozzle, the melt in said container having a maximum melt level, means to move the stopper rod upwards from the tapping nozzle to allow melt to flow out of the container and downwards to contact the tapping nozzle and prevent the flow of melt out of the tap hole, a plunger movably located within the hollow stopper rod, menas to move the plunger upwardly within the stopper rod to a rest position where, when the stopper rod is contacting the tapping nozzle, no part of the plunger is below the said maximum melt level and downwardly from that rest position into the tap hole, and means provided to turn the plunger about its axis with the stopper rod.

* * * * *